US008281860B2

(12) United States Patent
Boney et al.

(10) Patent No.: US 8,281,860 B2
(45) Date of Patent: Oct. 9, 2012

(54) METHOD AND SYSTEM FOR TREATING A SUBTERRANEAN FORMATION

(75) Inventors: Curtis Boney, Houston, TX (US); Somiari Ajumogobia-Bestman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 571 days.

(21) Appl. No.: 11/751,377

(22) Filed: May 21, 2007

(65) Prior Publication Data

US 2008/0047707 A1 Feb. 28, 2008

Related U.S. Application Data

(60) Provisional application No. 60/823,609, filed on Aug. 25, 2006.

(51) Int. Cl.
*E21B 43/114* (2006.01)

(52) U.S. Cl. ..... 166/298; 166/55; 166/192; 166/305.1

(58) Field of Classification Search ..... 166/54.1, 166/193, 284
See application file for complete search history.

(56) References Cited

U.S. PATENT DOCUMENTS

| | | | | |
|---|---|---|---|---|
| 2,642,142 | A * | 6/1953 | Clark | 166/281 |
| 2,693,854 | A * | 11/1954 | Abendroth | 166/278 |
| 3,707,194 | A * | 12/1972 | Svaldi | 166/305.1 |
| 5,131,472 | A * | 7/1992 | Dees et al. | 166/308.1 |
| 6,380,138 | B1 * | 4/2002 | Ischy et al. | 507/204 |
| 6,494,260 | B2 | 12/2002 | van Petegem | |
| 6,497,284 | B2 | 12/2002 | van Petegem | |
| 6,520,255 | B2 | 2/2003 | Tolman | |
| 6,543,538 | B2 * | 4/2003 | Tolman et al. | 166/284 |
| 6,957,701 | B2 | 10/2005 | Tolman | |
| 7,059,407 | B2 | 6/2006 | Tolman | |
| 7,225,869 | B2 | 6/2007 | Willett | |
| 7,278,486 | B2 * | 10/2007 | Alba et al. | 166/308.1 |
| 7,343,975 | B2 * | 3/2008 | Surjaatmadja et al. | 166/297 |
| 2005/0133226 | A1 * | 6/2005 | Lehman | 166/312 |
| 2005/0211439 | A1 * | 9/2005 | Willett et al. | 166/308.1 |
| 2006/0196667 | A1 * | 9/2006 | Alba et al. | 166/308.1 |
| 2007/0102156 | A1 | 5/2007 | Nguyen | |

* cited by examiner

*Primary Examiner* — Angela M DiTrani
(74) *Attorney, Agent, or Firm* — Robin Nava; Daryl Wright; Jeremy Tillman

(57) ABSTRACT

A system that is usable with a well includes a tubular string, which includes a jetting sub. Fluid is communicated outside an annular region that surrounds the string to a first zone of the well for purposes of treating the first zone. During the communication of the fluid through the annular region, fluid is communicated through the tubing string and through the jetting sub to perforate a second zone of the well.

19 Claims, 15 Drawing Sheets

METHOD AND SYSTEM FOR TREATING A SUBTERRANEAN FORMATION

This application claims the benefit under 35 U.S.C. §119 (e) to U.S. Provisional Application Ser. No. 60/823,609, entitled, "METHOD AND SYSTEM FOR TREATING A SUBTERRANEAN FORMATION," which was filed on Aug. 25, 2006, and is hereby incorporated by reference in its entirety.

BACKGROUND

The invention generally relates to a method and system for treating a subterranean formation.

Wellbore treatment methods often are used to increase hydrocarbon production by using a treatment fluid to affect a subterranean formation in a manner that increases oil or gas flow from the formation to the wellbore for removal to the surface. Hydraulic fracturing and chemical stimulation are common treatment methods used in a wellbore. Hydraulic fracturing involves injecting fluids into a subterranean formation at such pressures sufficient to form fractures in the formation, the fractures increasing flow from the formation to the wellbore. In chemical stimulation, flow capacity is improved by using chemicals to alter formation properties, such as increasing effective permeability by dissolving materials in or etching the subterranean formation. A wellbore may be an open hole or a cased hole where a metal pipe (casing) is placed into the drilled hole and often cemented in place. In a cased wellbore, the casing (and cement if present) typically is perforated in specified locations to allow hydrocarbon flow into the wellbore or to permit treatment fluids to flow from the wellbore to the formation.

To access hydrocarbon effectively and efficiently, it is desirable to direct the treatment fluid to target zones of interest in a subterranean formation. There may be target zones of interest within various subterranean formations or multiple layers within a particular formation that are preferred for treatment. In such situations, it is preferred to treat the target zones or multiple layers without inefficiently treating zones or layers that are not of interest. In general, treatment fluid flows along the path of least resistance. For example, in a large formation having multiple zones, a treatment fluid would tend to dissipate in the portions of the formation that have the lowest pressure gradient or portions of the formation that require the least force to initiate a fracture. Similarly in horizontal wells, and particularly those horizontal wells having long laterals, the treatment fluid dissipates in the portions of the formation requiring lower forces to initiate a fracture (often near the heel of the lateral section) and less treatment fluid is provided to other portions of the lateral. Also, it is desirable to avoid stimulating undesirable zones, such as water-bearing or non-hydrocarbon bearing zones. Thus it is helpful to use methods to divert the treatment fluid to target zones of interest or away from undesirable zones.

Diversion methods are known to facilitate treatment of a specific interval or intervals. Ball sealers are mechanical devices that frequently are used to seal perforations in some zones thereby diverting treatment fluids to other perforations. In theory, use of ball sealers to seal perforations permits treatment to proceed zone by zone depending on relative breakdown pressures or permeability. But frequently ball sealers prematurely seat on one or more of the open perforations, resulting in two or more zones being treated simultaneously. Likewise, when perforated zones are in close proximity, ball sealers have been found to be ineffective. In addition, ball sealers are useful only when the casing is cemented in place, as well as not effective when used alone for plugging non circular openings such as slots. Without cement between the casing and the borehole wall, the treatment fluid can flow through a perforation without a ball sealer and travel in the annulus behind the casing to any formation. Ball sealers have limited use in horizontal wells owing to the effects of formation pressure, pump pressure, and gravity in horizontal sections, as well as that possibility that laterals in horizontal wells may not be cemented in place.

Changes in pumping pressures are used to detect whether ball sealer have set in perforations; this inherently assuming that the correct number of ball sealers were deployed to seal all the relevant perforations and that the balls are placed in the correct location for diverting the treatment fluids to desired zones. Other mechanical devices known to be used for used for diversion include bridge plugs, packers, down-hole valves, sliding sleeves, and baffle/plug combinations; and particulate placement. As a group, use of such mechanical devices for diversion tends to be time consuming and expensive which can make them operationally unattractive, particularly in situations where there are many target zones of interest. Chemically formulated fluid systems are known for use in diversion methods and include viscous fluids, gels, foams, or other fluids. Many of the known chemically formulated diversion agents are permanent (not reversible) in nature and some may damage the formation. In addition, some chemical methods may lack the physical structure and durability to effectively divert fluids pumped at high pressure or they may undesirably affect formation properties. The term diversion agent herein refers to mechanical devices, chemical fluid systems, combinations thereof, and methods of use for blocking flow into or out of a particular zone or a given set of perforations.

In operation, it is preferred that the treatment fluid enters the subterranean formation only at the target zones of interest. It is more preferred that the treatment fluid treatment enters the subterranean formation on a stage-by-stage basis.

What is needed is a method and system providing increased efficiency in multiple zone treatments.

SUMMARY

In an embodiment of the invention, a technique that is usable with a well includes treating a first zone of the well. During the treatment of the first zone, a second zone of the well is perforated.

In another embodiment of the invention, a system that is usable with a well includes a tubular string, which includes a jetting sub. Fluid is communicated outside an annular region that surrounds the string to a first zone of the well for purposes of treating the first zone. During the communication of the fluid through the annular region, fluid is communicated through the tubing string and through the jetting sub to perforate a second zone of the well.

Advantages and other features of the invention will become apparent from the detailed description, drawing and claims.

DETAILED DESCRIPTION

The invention comprises a method for treating more than one target zone of interest and involves using a diversion agent to direct treatment fluid to the target zones. The present invention will be described in connection with its various embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

Figure 1:
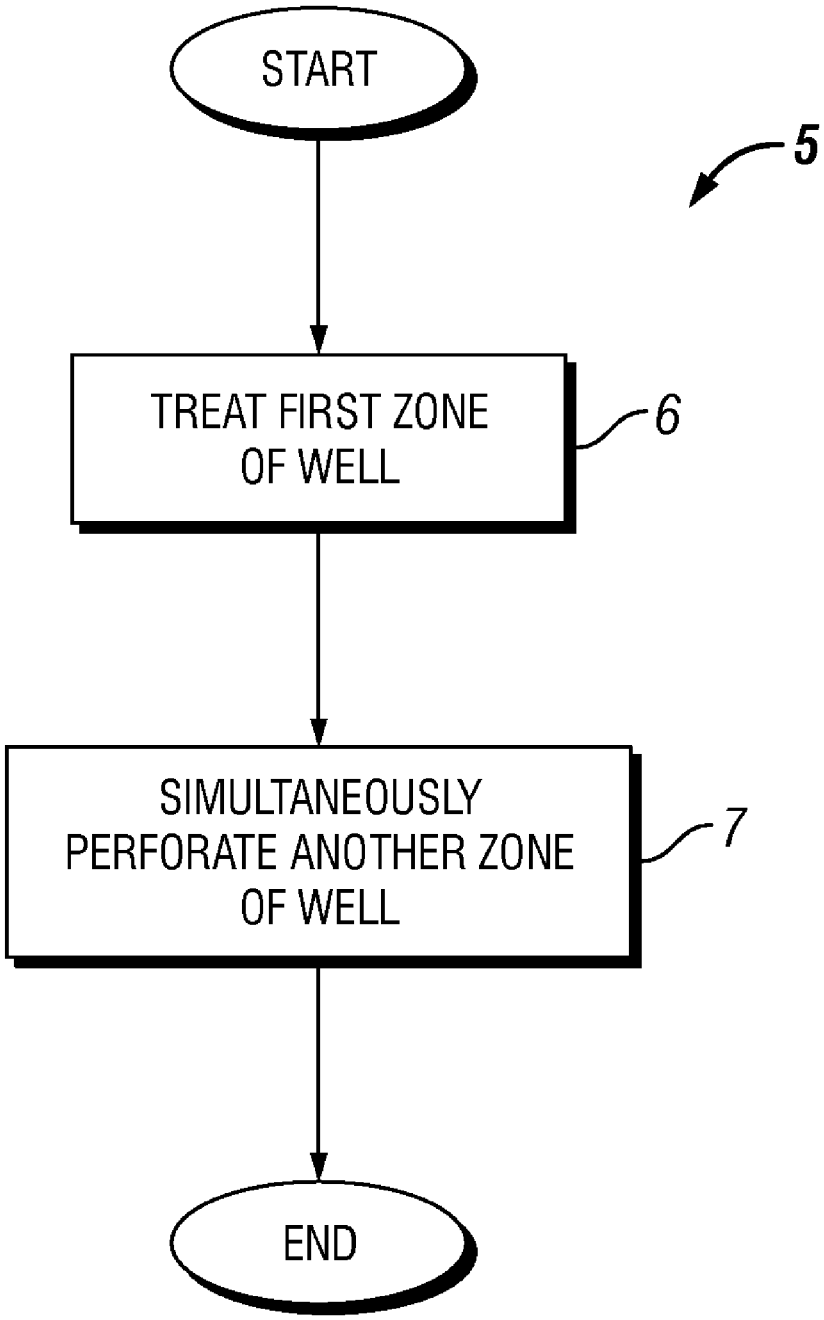
FIG. 1 is a flow diagram depicting a technique to treat and perforate zones of a well according to an embodiment of the invention.

Referring to FIG. 1, for purposes of improving efficiency during well completion, a technique 5 may be used in accordance with embodiments of the invention described herein. In general, the technique 5 includes treating (block 5) a first zone of the well and simultaneously perforating (block 7) another zone of the well. Due to the concurrent treatment and perforation of different zones of the well, completion costs are reduced as well as the time to production. As a more specific example, the technique 5 may be performed using coiled tubing and at least one jetting sub for purposes of establishing fluid connectivity with a producing formation. The treatment fluid may be communicated downhole between the annulus that surrounds the coiled tubing string. It is noted that the jetting sub and coiled tubing are merely examples of one out of many possible embodiments that are contemplated and are within the scope of the appended claims. For example, alternatively, a jointed tubing may be used in place of the coiled tubing string and/or shaped charge-based perforating gun may be used to perforate the zone. Additionally, the well may be cased or uncased, may be a subterranean or subsea well, may include lateral wellbores, etc., depending on the particular embodiment of the invention.

As a more specific example, FIGS. 2-6 illustrate the treatment and perforation of two exemplary zones (an upper zone 40 and a lower zone 30) of a well 10 in accordance with some embodiments of the invention. The well 10 includes a coiled tubing string 12, which extends through a main wellbore 14 of the well 10. The main wellbore intersects one or more formations and contains intervals in target zones of interest, such as the exemplary zones 30 and 40. It is noted that the wellbore 14 may be a lateral wellbore, in accordance with other embodiments of the invention and may be cased or uncased, depending on the particular embodiment of the invention.

In general, the coiled tubing string 12 has a bottom hole assembly (BHA) at its lower end. The BHA 25 includes a jetting sub 22 and a reversible check valve that controls when fluid is communicated through radial ports 23 of the jetting sub 22 in a jetting operation and when alternatively, fluid is communicated through a lower axially-aligned port 26 of the BHA 25 (and coiled tubing string 12) for such purposes of introducing a diversion fluid into a particular interval of the well 10. More specifically, the radial ports 23 of the jetting sub 22 are used for purposes of directing abrasive cutting fluid (which is introduced through a central passageway 52 of the coiled tubing string 12) toward the wellbore wall or casing (depending on whether the well 10 is cased) for purposes of forming perforations into the surrounding formation to bypass near wellbore damage caused by the drilling of the wellbore 14.

The port 26 of the reversible check valve is surrounded by a seat 27, which is sized to receive a corresponding ball for purposes of enabling the check valve and blocking communication from the central passageway 52 through the port 26. The check valve is enabled for purposes of enabling, or activating, the jetting sub 22. In this regard, when the jetting sub 22 is to be used for purposes of perforation, the ball is deployed from the surface of the well and descends through the coiled tubing's central passageway 52 to lodge in the seat 27 and thus, block fluid communication through the port 26. Therefore, subsequently-introduced cutting fluid (into the central passageway of the string 12) is directed from the central passageway of the tubing string 20 and through the radial ports 23 of the jetting sub 22. If, however, as further described herein, the jetting sub 22 is not to be used, but rather, the coiled tubing string 12 is used for purposes of introducing a fluid (such as a diversion agent) into the well 10, the ball may be removed from the seat 27 (the ball may be dissolved, as further described herein, for example) to allow fluid communication through the port 26.

Figure 2:
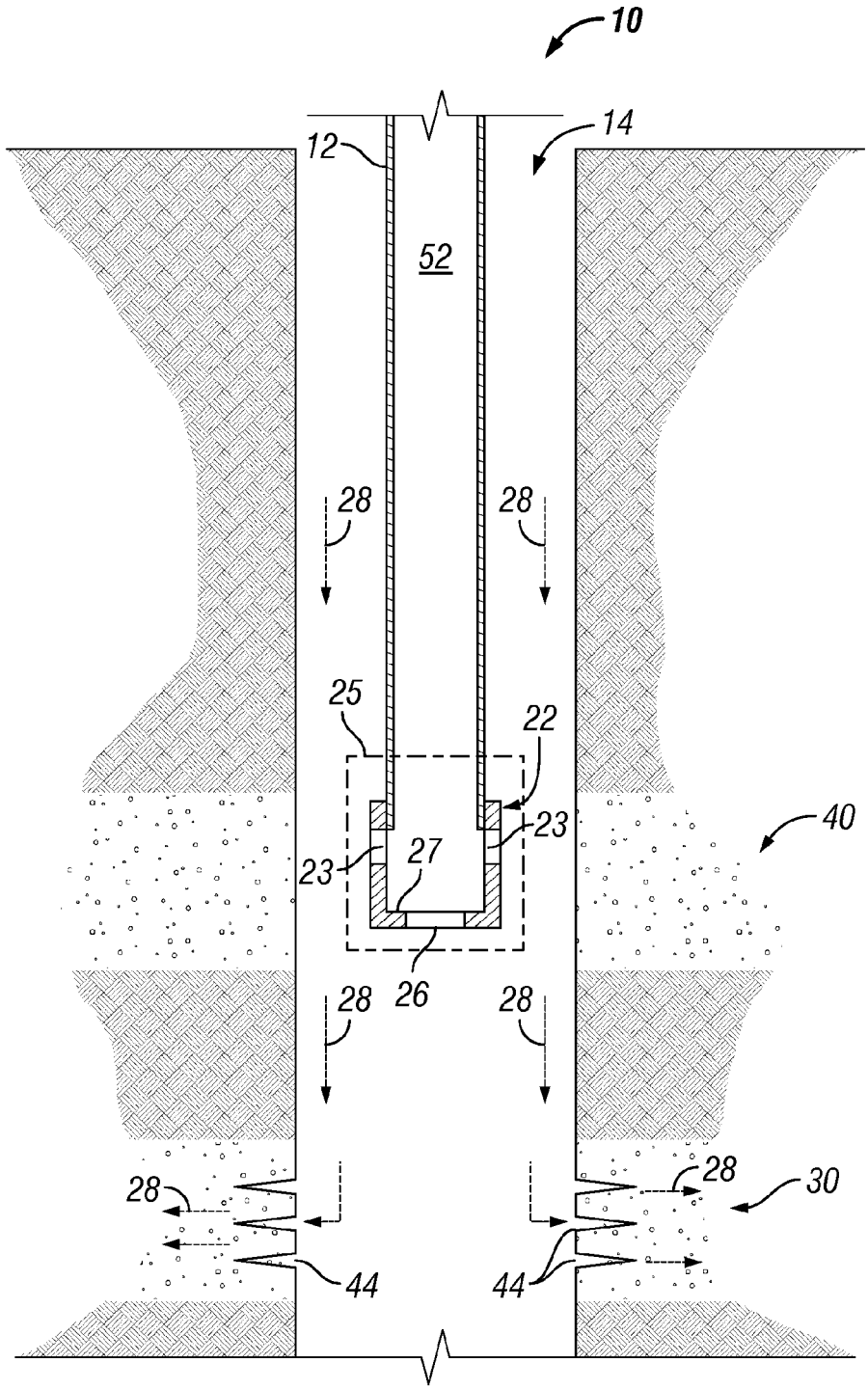
FIGS. 2, 3, 4, 5 and 6 are schematic diagrams of a well depicting the perforation and treatment of zones of the well using a coiled tubing string and a jetting sub according to an embodiment of the invention.

For the state of the well 10 depicted in FIG. 2, fluid connectivity has been established between the wellbore 14 and the lower target zone 30 for treatment via perforations 44 that were formed in a prior jetting operation. It should be understood that a target zone for treatment within a subterranean formation is intended to be broadly interpreted as any zone in which it is desired to treat, such as a permeable layer within a stratified formation, a zone within a thick formation that is distinguished by pressure or pressure gradient characteristics more than by stratigraphic or geologic characteristics, or a zone that is distinguished by the type or relative cut of fluid (e.g. oil, gas, water) in its pore spaces.

It should also be understood that the wellbore 14 may be constructed using known methods and may be open-hole or it may be cased-hole. The techniques that are disclosed herein may be employed advantageously to treat well configurations including, but not limited to, vertical wellbores, fully cased wellbores, horizontal wellbores, open-hole wellbores, wellbores comprising multiple laterals, and wellbores sharing one or more of these characteristics. A wellbore may have vertical, deviated, or horizontal portions or combinations thereof. In many instances, the casing string will be cemented in the wellbore, the method of cementing typically involving pumping cement in the annulus between the casing and the drilled wall of the wellbore. In some instances, particularly with respect to horizontal portions of the wellbore, the casing may not be cemented. It will be appreciated that the casing string may be a liner, broadly considered herein as any form of casing string that does not extend to the ground surface at the top of the well. Within the subterranean formations intersected by the wellbore are target zones of interest for treatment. In some instances, the target zones of interest for treatment may have differing stress gradients which may inhibit effective treatment of the zones without the use of a diversion agent.

Target zones for treatment may be designated in any number of ways known in the industry such as open-hole and/or cased-hole logs. A perforating device may be used by known methods to establish fluid connectivity between the wellbore and the formation. The jetting sub 22 is an example of one such perforating device. However, other perforating devices may be used in accordance with other embodiments of the invention, as the perforating device may be any device that is used in a wellbore to establish hydraulic communication between the wellbore 14 and a surrounding formation.

The coiled tubing string 12 is deployed into the wellbore 14 to a depth adjacent the next zone to be perforated using methods known to those skilled in the art. For the example that is depicted in FIG. 2, coiled tubing string 12 has its jetting sub 22 disposed in the upper zone 40, which is the next zone to be perforated for this example.

An apparatus or system for measuring or monitoring at least one parameter indicative of treatment is also used to advantage in embodiments of the invention. For example, when using hydraulic fracturing for treatment, preparations are made for monitoring by establishing a hydraulic fracturing monitoring system that is capable of detecting and monitoring microseisms in the subterranean formation that result from the hydraulic fracturing. Examples of known systems and methods for hydraulic fracture monitoring in offset wells are disclosed in U.S. Pat. No. 5,771,170, which is hereby incorporated herein in its entirety by reference. Alternatively, the apparatus or system for measuring or monitoring at least one parameter indicative of treatment may be deployed in the wellbore.

A system and method for hydraulic fracturing monitoring using tiltmeters in a treatment well is disclosed in U.S. Pat. No. 7,028,772, incorporated herein in its entirety by reference. For example, the measurement or monitoring device may be deployed with the coiled tubing such as the fiber optic tube within coiled tubing described U.S. patent application Ser. No. 11/111,230, published as U.S. Patent Application Publication No. 2005/0236161, incorporated herein in its entirety by reference. Other measurement or monitoring apparatuses suitable for use in the present invention include those known for use in determining borehole parameters such as bottom-hole pressure gauges or bottom-hole temperature gauges. Another example of systems and methods known for monitoring a least one parameter indicative of treatment (such as temperature or pressure) is disclosed in U.S. Pat. No. 7,055,604, which is hereby incorporated herein in its entirety by reference. Another example of measurements which may be monitored include tension or compression acting upon a downhole device (such as coiled tubing) as a indicator of fluid flow friction.

Still referring to FIG. 2, treatment of the lower zone 30 begins by pumping treatment fluid into the annulus between the coiled tubing string 12 and casing (in the case of a cased well) or between the coiled tubing string 12 and the wellbore wall (in the case of an open hole well), as depicted by annular flow 28. The treatment of a target zone by pumping treatment fluid is referred to herein as a treatment stage. The treatment fluid may be any suitable treatment fluid known in the art including, but not limited to, stimulation fluids, water, treated water, aqueous-based fluids, nitrogen, carbon dioxide, any acid (such as hydrochloric, hydrofluoric, acetic acid systems, etc), diesel, or oil-based fluids, gelled oil and water systems, solvents, surfactant systems, and fluids transporting solids for placement adjacent to or into a target zone, for example. A treatment fluid may include components such as scale inhibitors in addition to or separately from a stimulation fluid. In some embodiments of the invention, the treatment fluid includes proppant, such as sand, for placement into hydraulic fractures in the target zone by pumping the treatment fluid at high enough pressures to initiate fractures. Equipment (tanks, pumps, blenders, etc.) and other details for performing treatment stages are known in the art and are not described for reasons of simplicity.

A treatment model that is appropriate for matrix and/or fracture pressure simulation may be performed to model a planned well treatment in conjunction with the disclosed method. Such models are well known in the art with many models being useful for predicting treatment bottom-hole pressures. The data generated from such a model may be compared to bottom hole treating pressures (BHTP) during previously described well treatment phase of the disclosed method.

Figure 3:
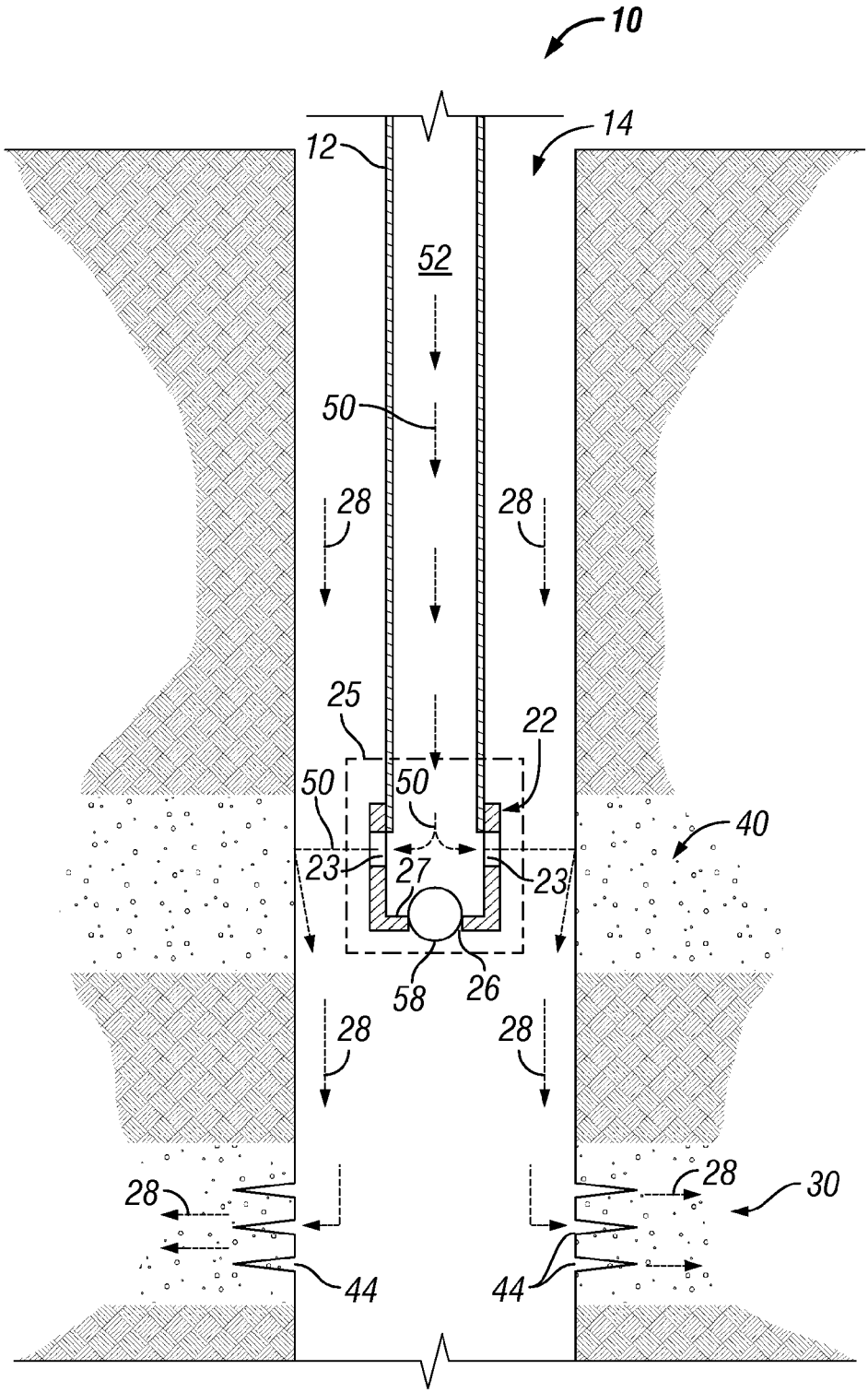

Referring to FIG. 3, the jetting, or perforation, of the upper zone 40 begins while the treatment of zone 30 is occurring. When jetting of the upper interval 40 is to commence, a ball 58 is dropped from the surface of the well 10. The ball 58 is commensurate with the seat 27 of the reversible check valve and lodges in the seat 27 to activate the jetting sub 22. Once the jetting sub 22 is activated, an abrasive slurry (i.e., a cutting fluid) is pumped down the central passageway 52 of the coiled tubing string 12 (as depicted by flow 50) to cut perforations into the upper zone 40, as the lower zone 30 is simultaneously being treated. As an example, the abrasive slurry may contain a solid, such as sand, bauxite, ceramics or marble.

The pressure of the flow 50 may be monitored at the surface of the well 10 for purposes of detecting a characteristic signature of the pressure, which indicates that sufficient fluid connectivity between the wellbore 14 and the upper zone 40 has been established (i.e., which indicates sufficient formation perforation has occurred in interval 40). Thus, once a pressure signature indicating that sufficient fluid connectivity has been established between the wellbore and the upper zone 40, the jetting operation ceases.

In some embodiments of the invention, the ball 58 that is dropped to block flow through the port 26 and activate the jetting sub 22 may be made of a reactive material, such as magnesium or aluminum. To cease jetting operations, a reactive fluid may be pumped down the central passageway 52 of the coiled tubing string 12 to dissolve the ball 58 and decommission the jetting sub 22 so that the sub 22 is no longer able to cut. It may be more advantageous for efficiency and logistics purposes to pump the reactive fluid down the annulus back up into the tool to dissolve the ball. With the removal of ball 58, a free path down the central passageway 52 of the tubing string 12 is once again established (i.e., communication through the port 26 is established) to allow for such operations as diversion or acidizing.

Figure 4:
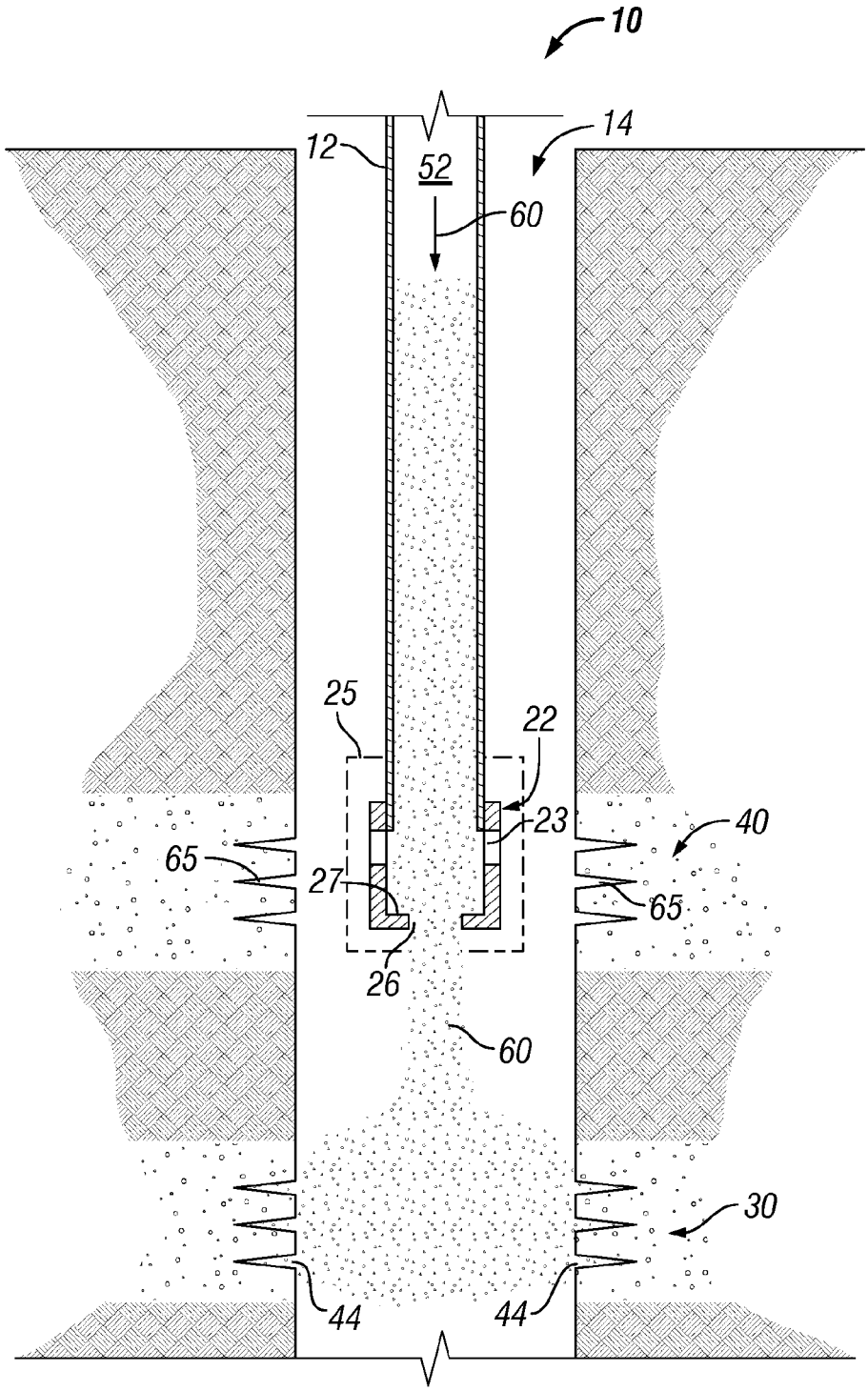

Referring to FIG. 4, at the conclusion of the treatment of the lower zone 30 and the perforation of the upper zone 40 (which forms perforations 65), a diversion agent is pumped through the central passageway 52 of the coiled tubing string 12 and through the string's lower port 26. The target zone of the diversion agent for this example is the previously-treated lower zone 30. The diversion of fluid from the wellbore to a subterranean formation or the diversion of a fluid from a subterranean formation to the wellbore is referred to herein as a diversion stage. The diversion agent is preferable suitable for acting as a diversion agent in the formation or in the perforations. In some embodiments, the diversion agent may be a fluid that contains fiber. Known methods for including fibers in treatment fluids and suitable fibers are disclosed in U.S. Pat. No. 5,501,275, which is hereby incorporated herein by reference in its entirety. In some embodiments, the diversion agent may comprise degradable material. Known compositions and methods for using slurry comprising a degradable material for diversion are disclosed in U.S. patent application Ser. No. 11/294,983, published as U.S. Patent Application Publication No. 2006/0113077, which are each hereby incorporated herein by reference in its entirety.

The placement of the diversion agent may be monitored based on a measured parameter to determine or confirm placement of the diversion agent. As permeable areas of the target interval (pore throats, natural and created fractures and vugs, etc.) are plugged by diversion agent, pressure typically increases. So, for example, while pumping the diversion agent, the surface or bottom hole treating pressure may be monitored for any pressure changes as the diversion agent contacts the formation, a pressure change being indicative of placement of the diversion agent. The dissolving capacity of a degradable diversion agent, when used, preferentially is calibrated to the sequencing of treatment stages to provide diversion from the interval into which is has been placed throughout all the treatment stages.

Figure 5:
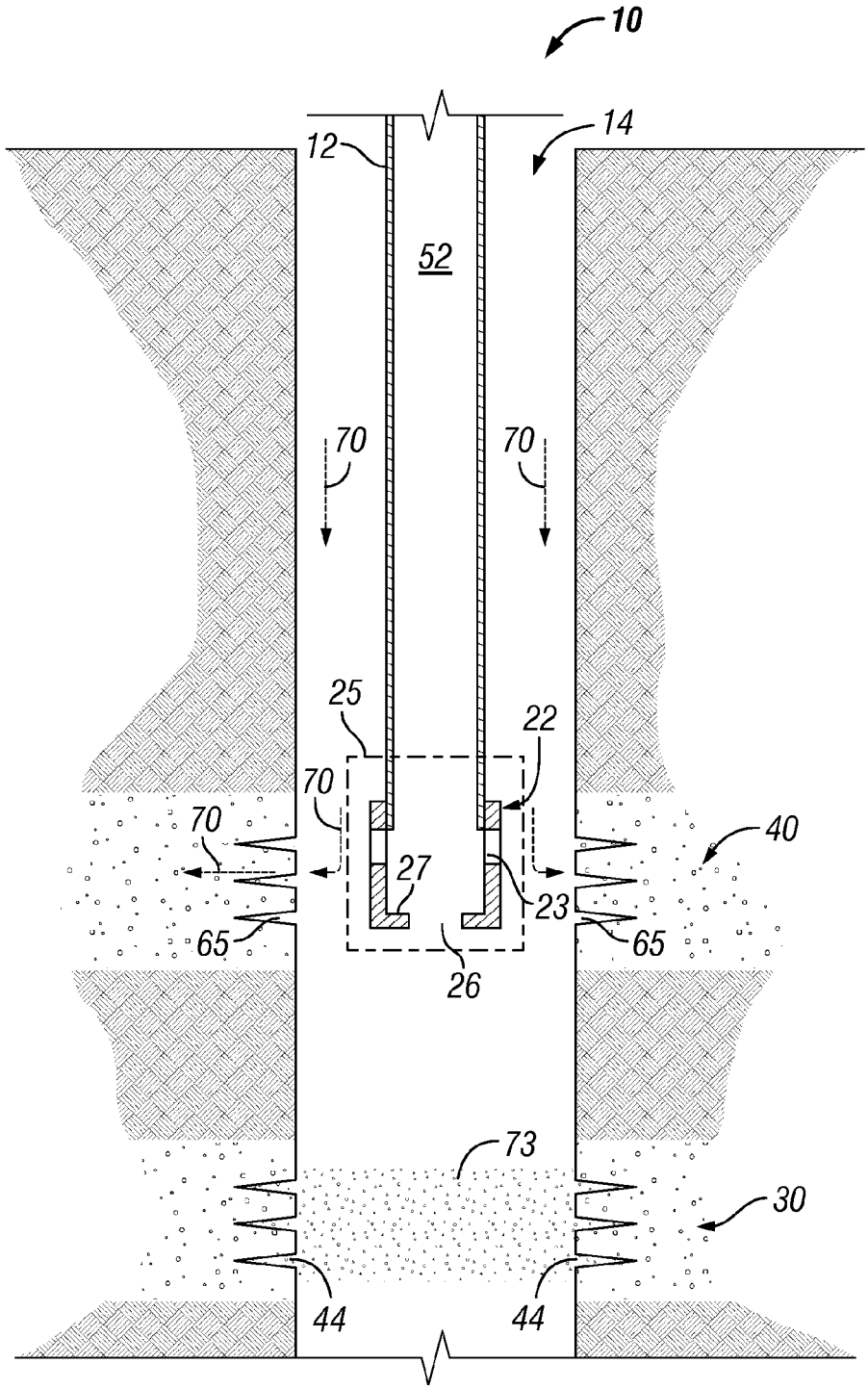
Figure 6:
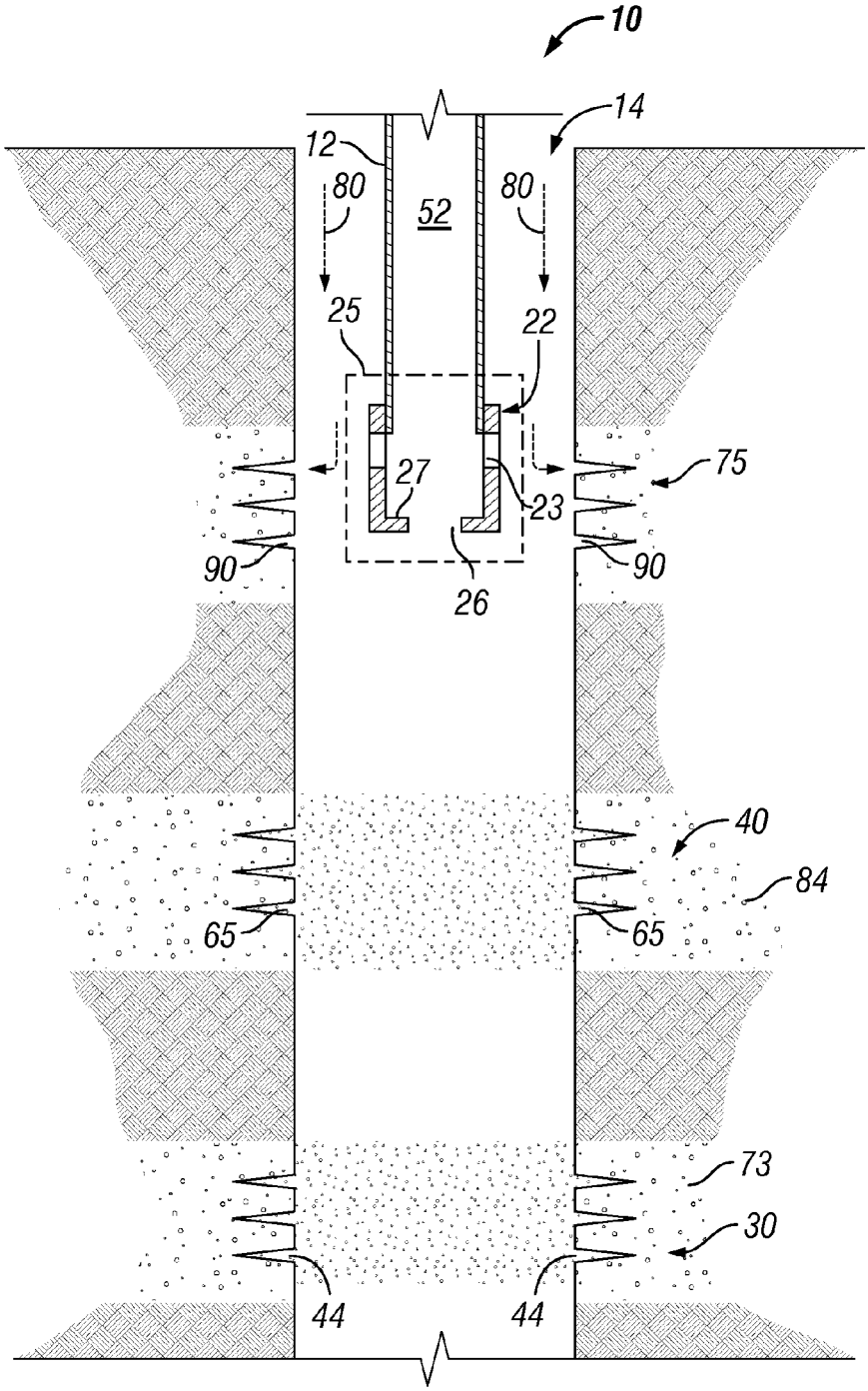

Referring to FIG. 5, after the diversion agent has been placed in the lower zone 30 (as indicated at reference numeral 73), the treatment of the upper zone 40 begins by pumping treatment fluid (as depicted by annular flow 70) into the annulus between the coiled tubing string 12 and casing/wellbore wall, depending on whether the wellbore 14 is cased. The treatment fluid is communicated through perforations 65, which were previously formed by the jetting sub 22 (see FIG. 3). While the upper zone 40 is being treated, the jetting sub 22 is repositioned adjacent the next target zone and the acts for perforating and treating pursuant to the technique 5 (FIG. 1) are repeated. FIG. 6 illustrates both the upper zone 40 and the lower zone 30 being blocked by a diversion agent (at reference numerals 84 and 73, respectively) and the treatment of the next target zone 75 above the upper zone 40, as illustrated by annular flow 80.

Figure 7:
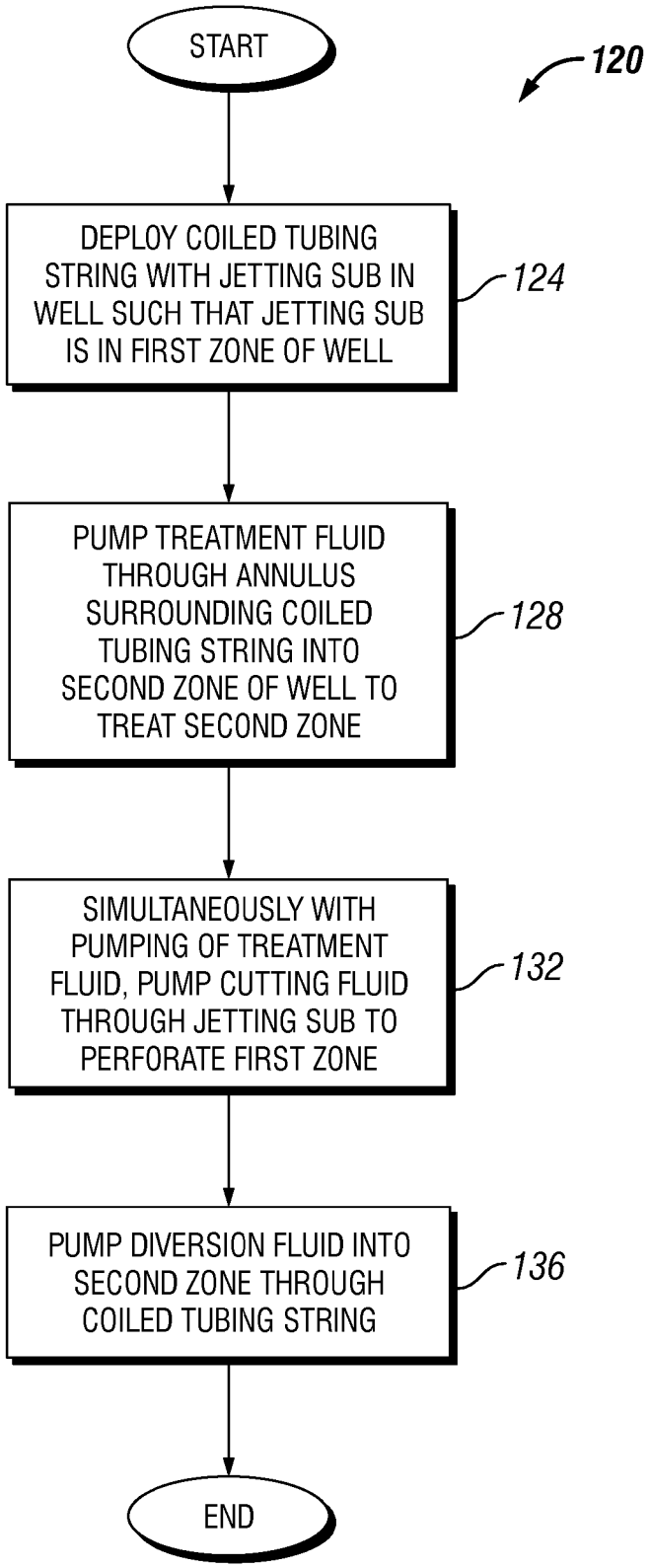
FIG. 7 is a flow diagram depicting a technique to treat and perforate zones of a well using a coiled tubing string and a jetting sub according to an embodiment of the invention.

To summarize, FIG. 7 depicts a technique 120, which may be generally used to perforate and treat first and second zones of a well. Pursuant to the technique 120, a coiled tubing string with a jetting sub is deployed in a well, such that the jetting sub is in a first zone of the well, pursuant to block 124. Treatment fluid is pumped (block 128) through the annulus, which surrounds the coiled tubing string into a second zone of the wellbore to treat the second zone. Simultaneously with the pumping of the treatment fluid, an abrasive cutting fluid, or slurry, is pumped through the jetting sub to perforate the first zone, pursuant to block 132. Diversion fluid is then pumped (block 136) into the second zone through the coiled tubing string.

FIGS. 8-13 generally depict a system to treat and perforate multiple zones of a well 200 in accordance with another embodiment of the invention. The well 200 includes a coiled tubing string 212 that is deployed in a wellbore 210 and includes multiple assemblies 239, each of which may have the same general design as the BHA 25 (see FIG. 2, for example). In this regard, each assembly 239 has a jetting sub 240 and a reversible check valve. The check valves have differently-sized seats, however, which allows selective and individual activation of the jetting subs 240 through the use of differently-sized balls that may be dropped through a central passageway 232 of the coiled tubing string 212.

For example, in accordance with some embodiments of the invention, the lowest jetting sub 240 may be activated by the smallest diameter ball such that the ball passes through the assemblies above the lowest jetting sub 240 to lodge in the sub's associated check valve. Subsequently, the jetting subs 240 above the lowest sub 240 may be activated pursuant to a bottom-to-top sequence by dropping increasingly larger balls. Thus, the top jetting sub 240 is activated using the largest diameter ball. Although the jetting subs 240 are described as being activated in a sequence from bottom of the well to the top of the well, it is understood that the jetting subs 240 may be activated using other techniques and/or sequences according to other embodiments of the invention.

Figure 8:
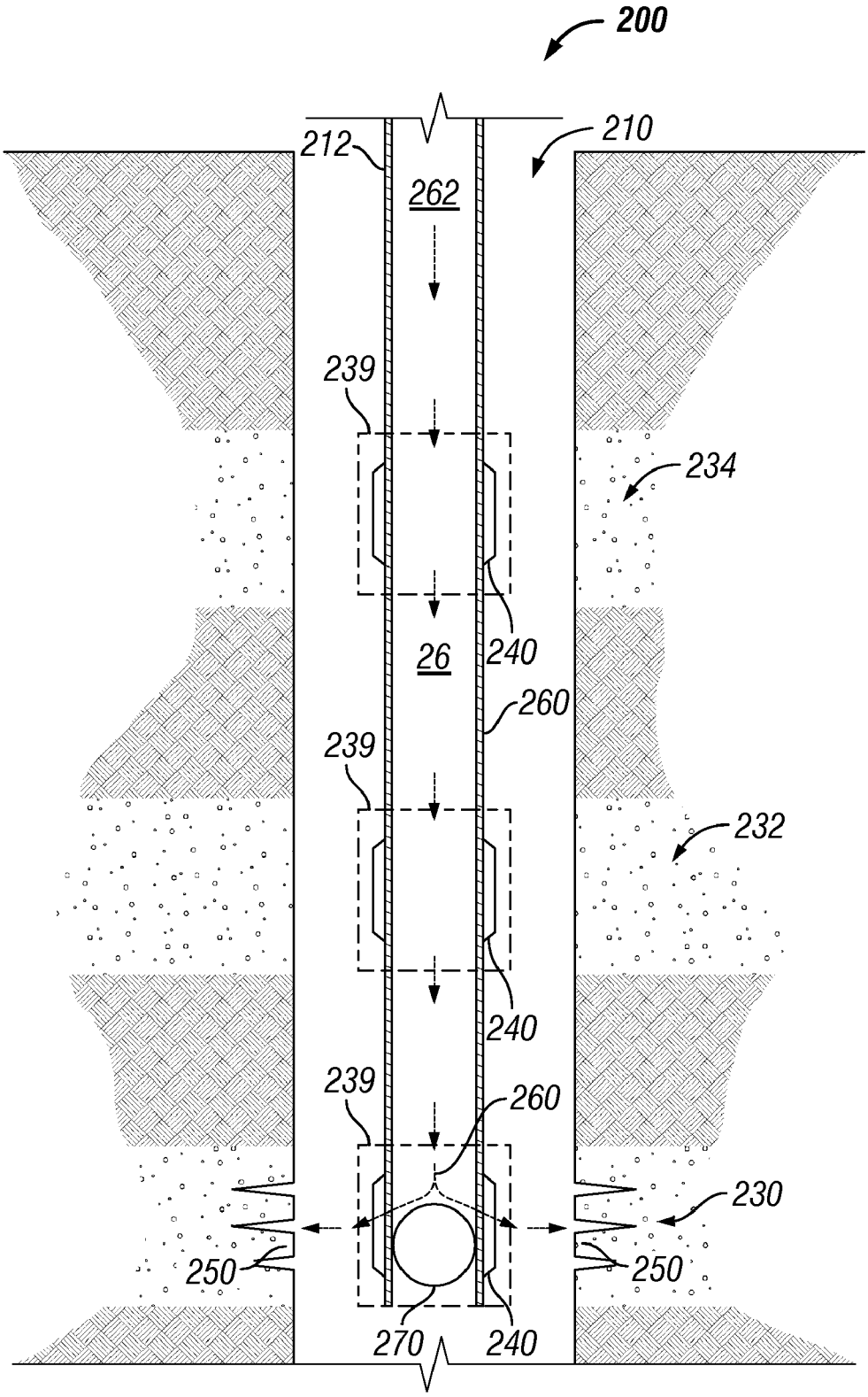
FIGS. 8, 9, 10, 11, 12 and 13 are schematic diagrams of a well illustrating the perforation and treatment of zones of the well using a coiled tubing string having multiple jetting subs according to an embodiment of the invention.
Figure 9:
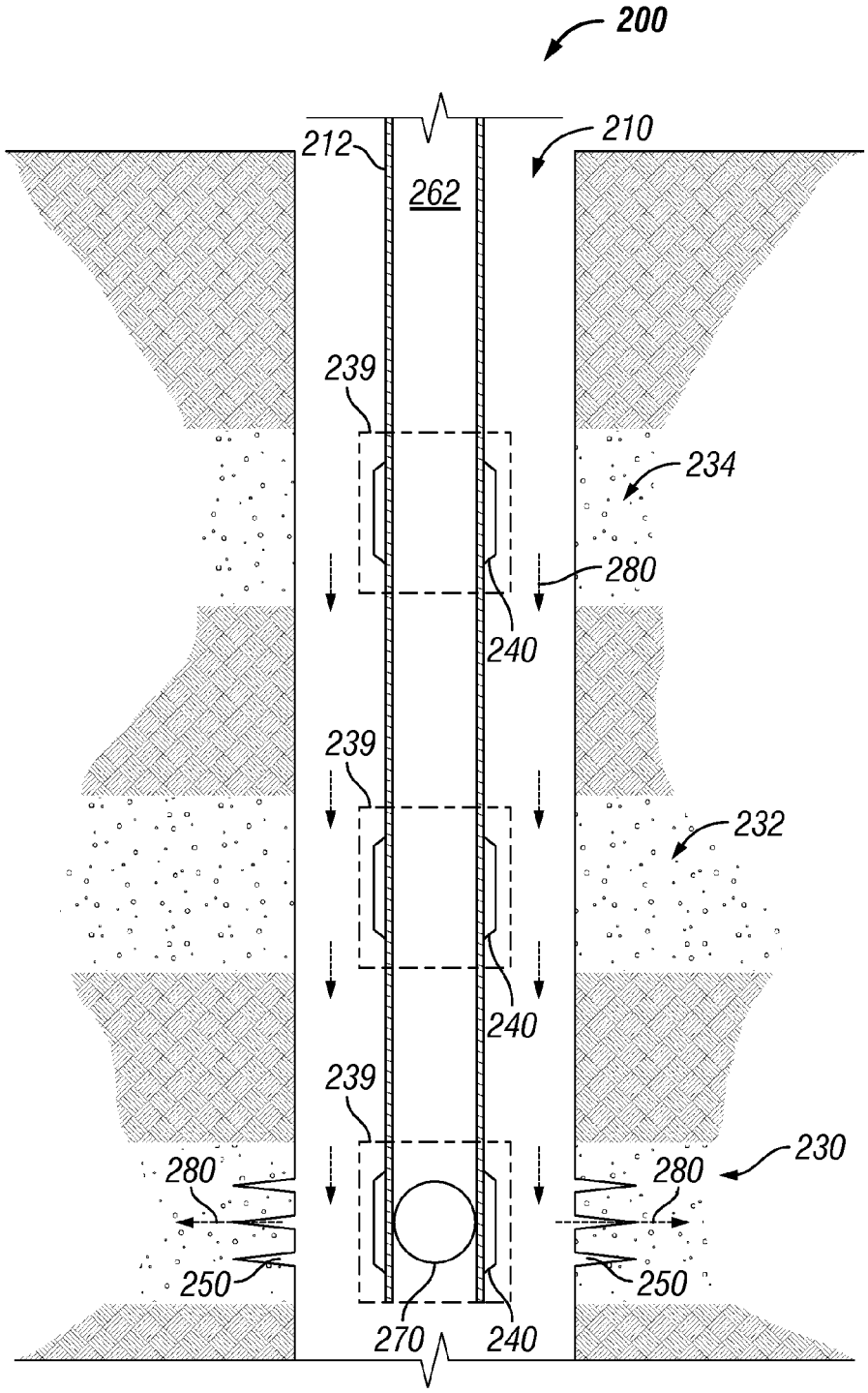

As depicted in FIG. 8, the coiled tubing string 212 is positioned such that the jetting subs 240 are adjacent exemplary bottom 230, intermediate 232 and upper 234 zones of interest. The spacing of the jetting subs 240 may be achieved by varying the intermediate tubular lengths between the assemblies 239 or by use of telescoping spacer elements, for example.

To begin the treatment/perforation with the coiled tubing string 210, a first ball 270 (the ball having the smallest diameter, for example) may be dropped through the central passageway 262 of the coiled tubing string 212 to activate the jetting sub 240 in the lowest zone 230. Thus, the ball 270 activates the lowest jetting sub 240 for purposes of facilitating cutting to establish fluid connectivity between the wellbore 210 and the zone 230 via perforations 250 that are formed by the jetting. After fluid connectivity has been established, the jetting operation ceases, and a treatment fluid is pumped down the annulus to treat the lowest interval 230, as depicted by annular flow 280 in FIG. 9.

Figure 10:
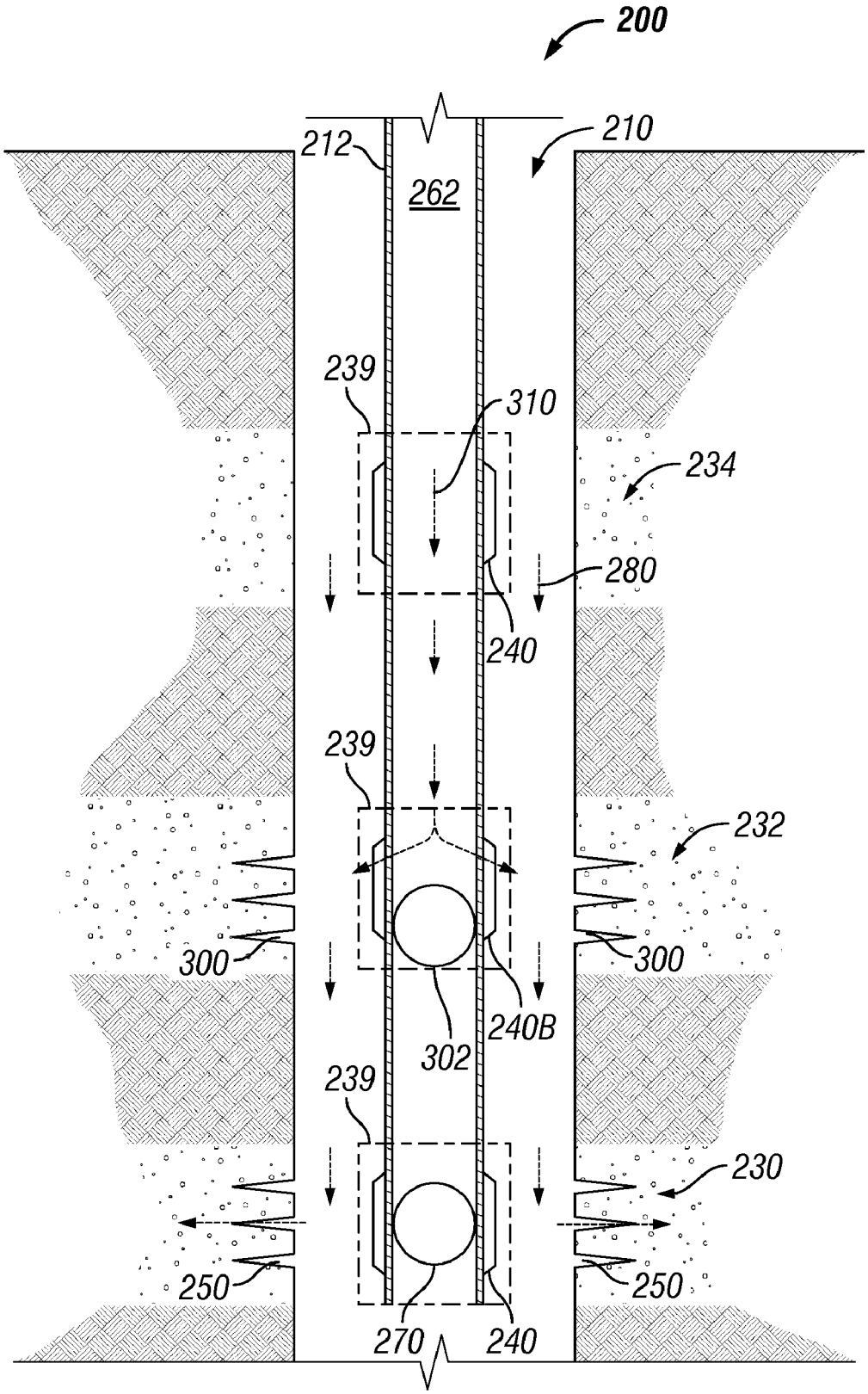

Referring to FIG. 10, during the treatment of the lowest zone 230, a second ball 302 is dropped down the central passageway 262 of the coiled tubing string 212 to activate the jetting sub 240 that is located in the intermediate zone 232. Thus, the ball 302 lodges in the seat of the associated check valve to activate the jetting sub 240.

Figure 11:
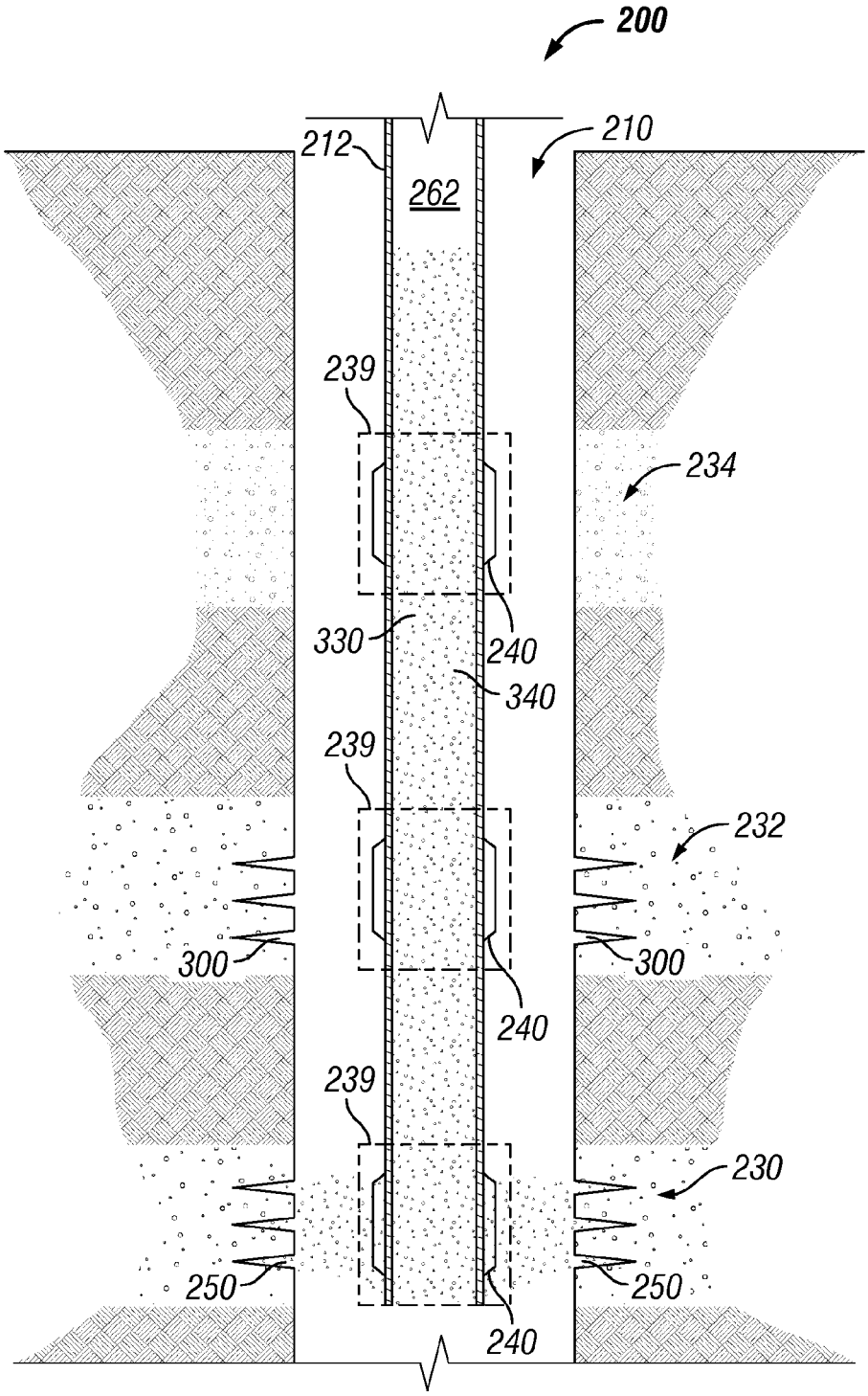

After the characteristic pressure signature indicates that fluid communication is established between the wellbore 210 and the intermediate zone 232 (thereby forming perforations 300), jetting operations cease. A reactive fluid may be pumped down the central passageway 262 of the coiled tubing string 212 to dissolve the balls 270 and 302. Thus, with the removal of the balls 270 and 302, communication is established along the entire length of the central passageway 262 of the coiled tubing string 212 for purposes of permitting the introduction of a diversion agent (represented by a flow 340), as depicted in FIG. 11. The diversion agent enters the lowest zone 230 to seal off fluid communication with the zone 230 for purposes of facilitating further treatment of the well 200.

Figure 12:
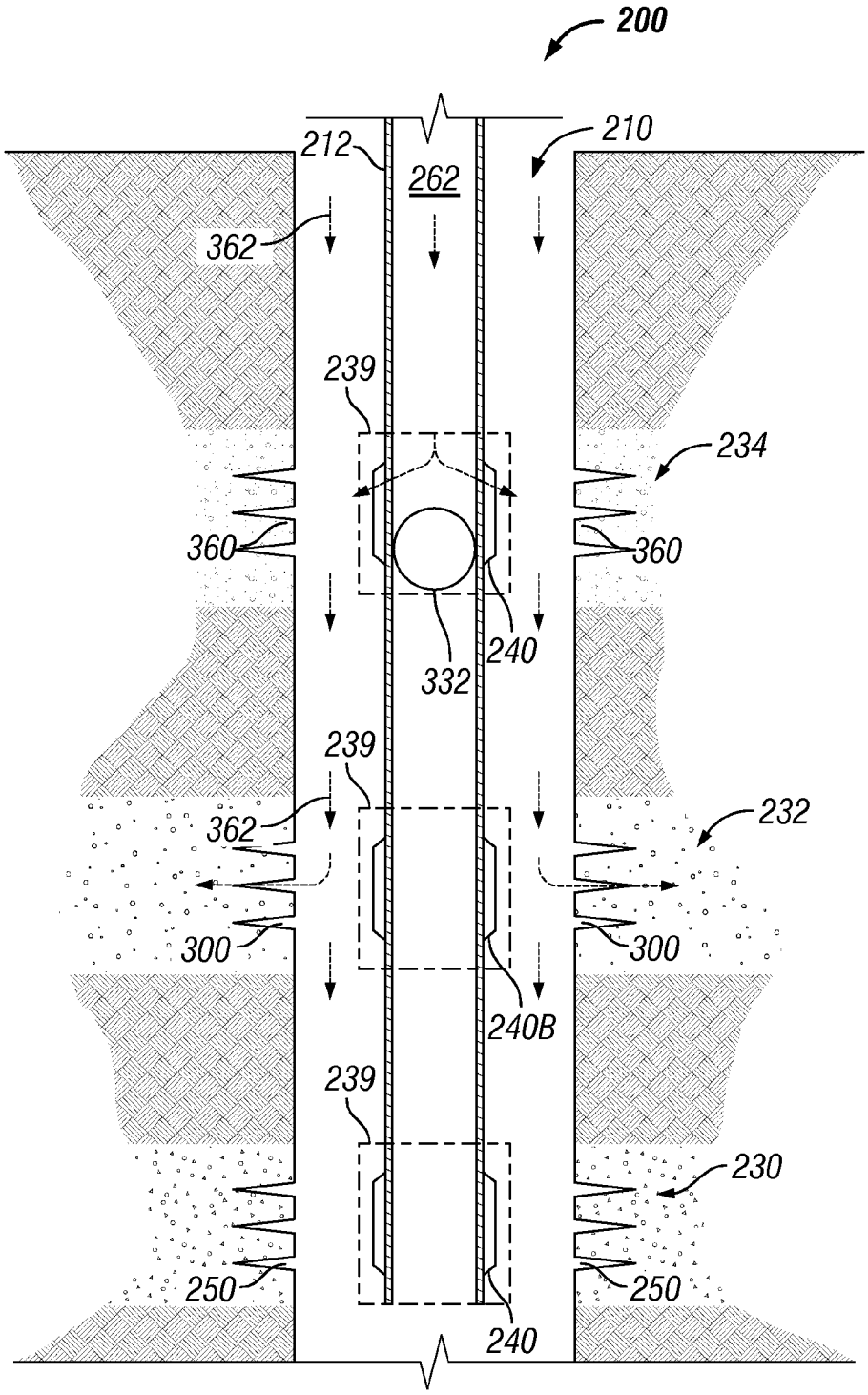
Figure 13:
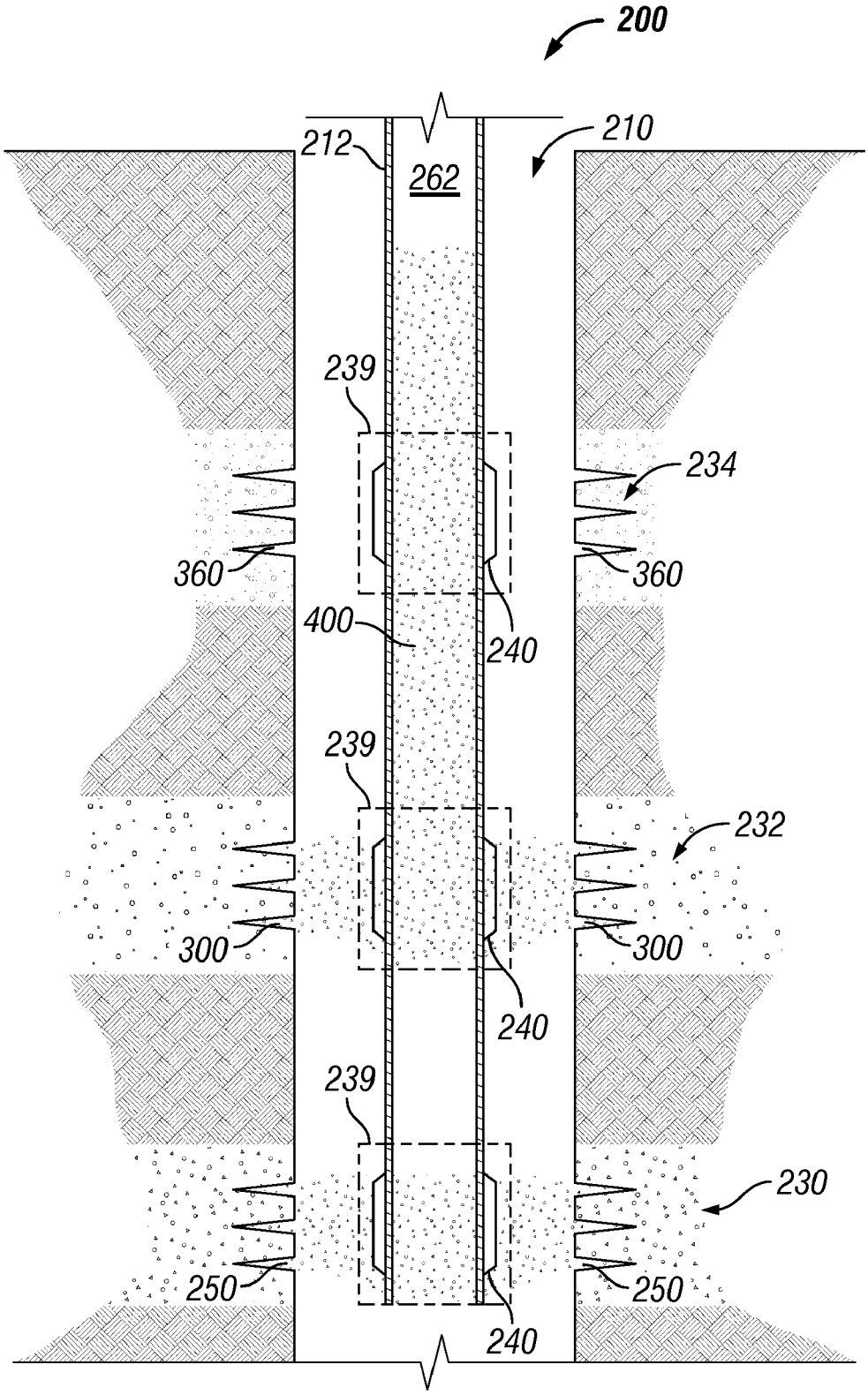

The above-described treatment and perforation process may be repeated for subsequent zones without repositioning the coiled tubing string 212. In this regard, FIG. 12 depicts a ball 332 that is lodged in the check valve associated with the uppermost jetting sub 240 of FIG. 12 for purposes of activating the jetting sub 240 to perforate and establish fluid connectivity with the upper zone 234 (to ultimately form perforations 360). As shown in FIG. 12, a treatment fluid (depicted by annular flow 362) is simultaneously communicated through the annulus for purposes of treating the intermediate zone 232, via the perforations 300 that were previously formed in the zone 232. Referring to FIG. 13, at the conclusion of the treatment of the intermediate zone 230, the ball 332 (see FIG. 12) may be dissolved to permit communication of a diversion agent (depicted by a flow 400 in FIG. 13) through the central passageway 262 of the coiled tubing string 212 into the intermediate zone 232.

Figure 14A:
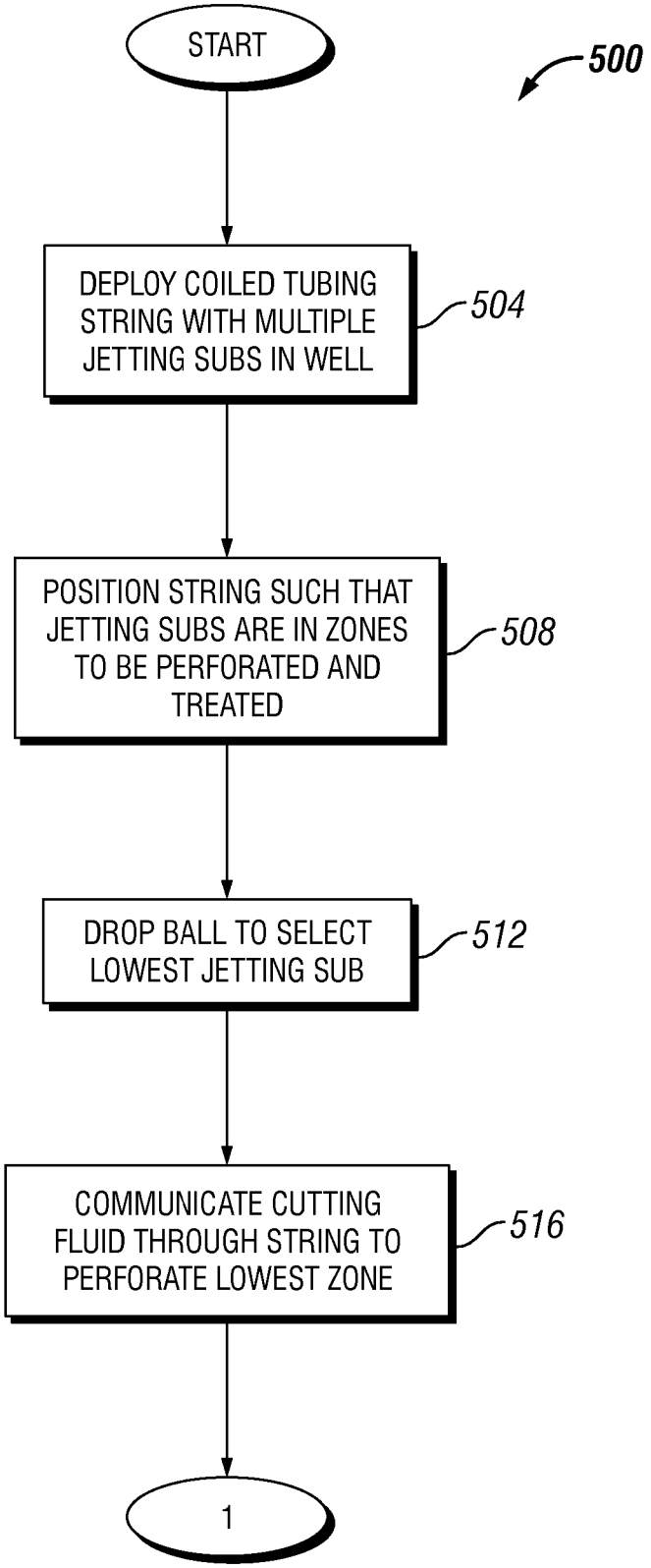
FIGS. 14A and 14B are flow diagrams depicting a technique to perforate and treat zones of a well using a coiled tubing string having multiple jetting subs according to an embodiment of the invention.
Figure 14B:
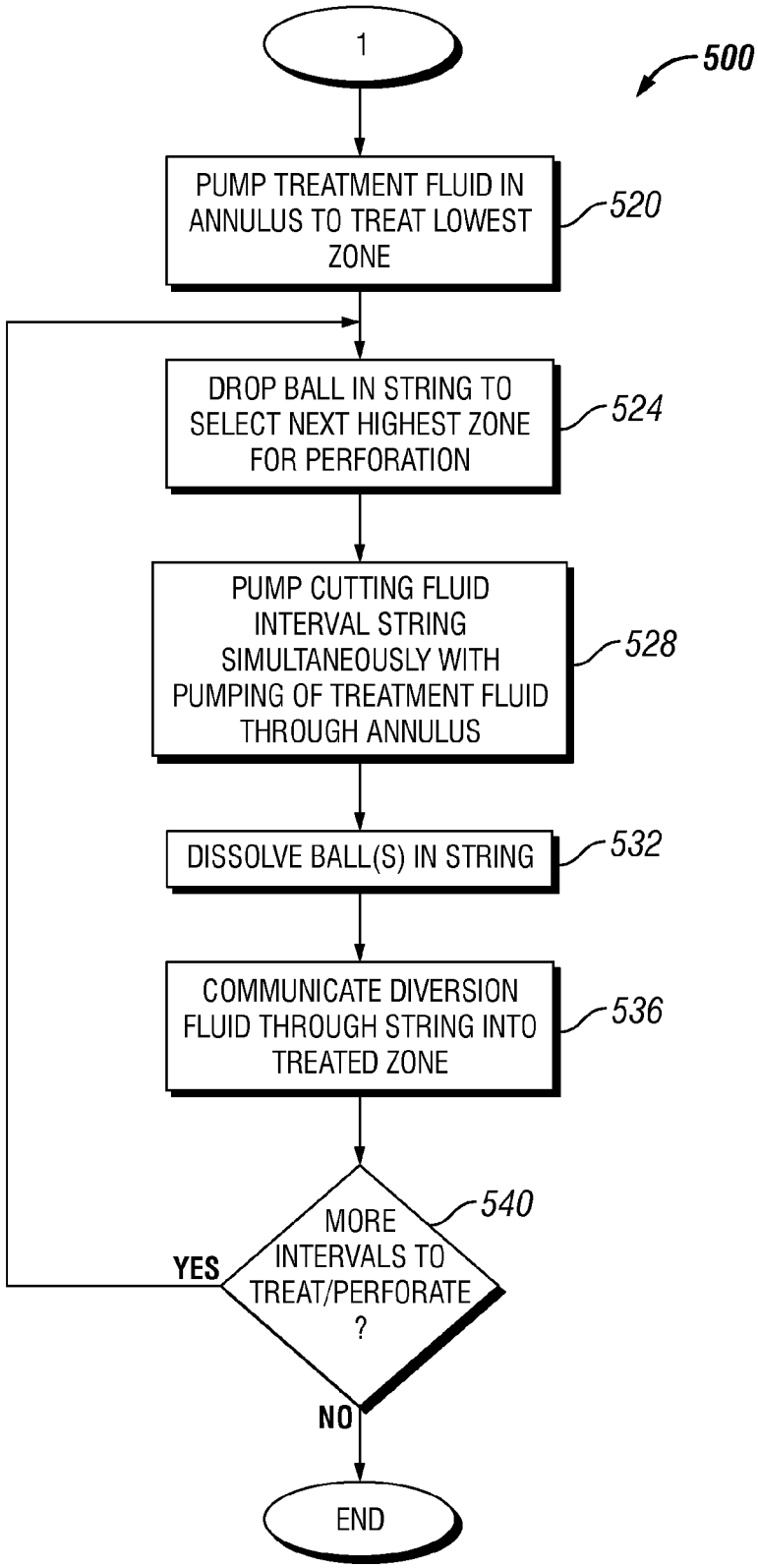

To summarize, a technique 500 that is generally depicted in FIGS. 14A and 14B may be used to perforate and treat multiple zones of a well in accordance with embodiments of the invention. Referring to FIG. 14A, a coiled tubing string that has multiple jetting subs is deployed in a well, pursuant to block 504. The string is positioned such that the jetting subs are in zones to be perforated and treated, pursuant to block 508. A ball may then be dropped (block 512) to select the lowest jetting sub, and subsequently, cutting fluid may be communicated through the coiled tubing string to perforate the lowest interval, pursuant to block 516. Referring also to FIG. 14B, treatment fluid may then be pumped into the annulus to treat the lowest untreated zone, pursuant to block 520.

At the conclusion of the perforation and treatment of the lowest zone, the technique 500 transitions into a repetitive loop for purposes of treating and perforating the zones above the lowest zone. The loop includes dropping (block 524) an appropriately-sized ball in the coiled tubing string to select the next highest zone for perforation and pumping (block 528) an abrasive cutting fluid through the coiled tubing string simultaneously with the pumping of the treatment fluid through the annulus. Next, the ball is dissolved, pursuant to block 532; and subsequently, a diversion fluid is communicated (block 536) through the central passageway of the coiled tubing string into the treated zone.

If more intervals remain to be treated/perforated (diamond 540), the loop continues by transitioning to block 524 for purposes of dropping the next-appropriately sized ball in the central passageway of the coiled tubing string and next performing the perforation and treatment pursuant to blocks 528-538.

Other embodiments are within the scope of the appended claims. For example, in some embodiments of the invention, the jetting operation in a particular zone may be combined with stimulation of the zone. In this regard, a gel that contains a fluid loss prevention agent may first be communicated into the zone before the jetting operation, as described in U.S. patent application Ser. No. 11/751,172, entitled, "METHOD AND SYSTEM FOR TREATING A SUBTERRANEAN FORMATION USING DIVERSION," which was filed on May 21, 2007, and is hereby incorporated by reference in its entirety.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

We claim:

1. A method usable with a well, comprising:

treating a first zone of the well; and during the treating, perforating a second zone of the well; wherein the perforating comprises:

providing a coiled tubing string or a jointed tubing, the coiled tubing string or the jointed tubing having multiple jetting subs spaced apart along a length of the coiled tubing string or the jointed tubing and associated with multiple zones of the well, one of the jetting subs being associated with the second zone; and deploying an object in the coiled tubing string or the jointed tubing to block fluid communication in the coiled tubing string or the jointed tubing below the one jetting sub associated with the second zone to cause fluid communicated through the coiled tubing string or the jointed tubing to exit the string or the jointed tubing at the one jetting sub associated with the second zone.

2. The method of claim 1, wherein the act of treating the first zone comprises:

communicating treating fluid through an annular region that surrounds the coiled tubing string or the jointed tubing by introducing a treatment fluid downward through the annular region to the first zone.

3. The method of claim 1, further comprising:

at the conclusion of the treating of the first zone of the well, introducing a fluid containing a diversion agent through the coiled tubing or the jointed tubing to the first zone.

4. The method of claim 3, wherein the diversion agent comprises fiber.

5. The method of claim 3, wherein the diversion agent comprises degradable material.

6. The method of claim 1, wherein the first zone is located downhole from the second zone.

7. The method of claim 1, wherein a portion of the well comprises a lateral wellbore.

8. The method of claim 1, wherein the first zone is part of a wellbore and the second zone is part of the wellbore.

9. The method of claim 1, further comprising:

repeating the acts of treating and perforating for additional zones of the well.

10. The method of claim 1, further comprising:

removing the object after the completion of the perforating of the second zone to permit perforation of another zone with another one of the jetting subs.

11. The method of claim 10, wherein the object comprises a ball and the act of removing the object comprises dissolving the ball.

12. The method of claim 1, further comprising:

using the other jetting subs to sequentially perforate other zones of the well.

13. The method of claim 12, wherein the act of using the other jetting subs comprises:

deploying differently-sized objects in the coiled tubing string to sequentially activate said other jetting subs.

14. A system usable with a well, comprising:

a pump to communicate a treatment fluid into the well to treat a first zone of the well; and a string comprising a plurality of perforating devices that comprise a plurality of jetting subs, the plurality of perforating devices spaced apart along the length of the string adapted to be activated in a sequence to perforate different zones without requiring relocation of the string and to perforate a second zone of the well while simultaneously allowing the passage of the treatment fluid to the first zone, wherein each of the jetting subs is adapted to be activated to communicate fluid from the sub to perforate a surrounding region of the well in response to a differently-sized object blocking fluid communication downstream of the jetting sub.

15. The system of claim 14, wherein the string comprises a coiled tubing string.

16. The system of claim 14, wherein the pump communicates the treatment fluid through an annular region that surrounds the string.

17. The system of claim 14, further comprising:

a pump to communicate a diversion fluid through the string at the conclusion of the treatment of the first zone.

18. The system of claim 14, wherein the string is adapted to communicate a diversion fluid into the first zone at the conclusion of the treatment of the first zone.

19. The system of claim 14, wherein the string is adapted, to communicate fluid to perforate additional zones of the well during communication of treatment fluid to said additional zones of the well.

* * * * *